US007528821B2

(12) United States Patent
Baek et al.

(10) Patent No.: US 7,528,821 B2
(45) Date of Patent: May 5, 2009

(54) METHOD OF DRIVING LIQUID CRYSTAL DISPLAY FOR EXPANDING AN EFFECTIVE PICTURE FIELD

(75) Inventors: Jong Sang Baek, Kumi-shi (KR); Sun Young Kwon, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 548 days.

(21) Appl. No.: 10/875,569

(22) Filed: Jun. 25, 2004

(65) Prior Publication Data

US 2005/0104826 A1 May 19, 2005

(30) Foreign Application Priority Data

Nov. 18, 2003 (KR) ..... 10-2003-0081426

(51) Int. Cl.
*G09G 3/36* (2006.01)

(52) U.S. Cl. ..... 345/103; 345/87

(58) Field of Classification Search ..... 345/87, 345/98, 94, 103, 211–214, 100, 208
See application file for complete search history.

(56) References Cited

U.S. PATENT DOCUMENTS 4,822,142 A * 4/1989 Yasui ..... 349/48
5,287,100 A * 2/1994 Guttag et al. ..... 345/213
5,610,628 A * 3/1997 Yamamoto et al. ..... 345/100
5,903,250 A * 5/1999 Lee et al. ..... 345/100
6,417,829 B1 * 7/2002 Jung et al. ..... 345/98
2001/0017611 A1 * 8/2001 Moriyama ..... 345/100
2002/0044119 A1 * 4/2002 Kwon ..... 345/87
2002/0140691 A1 * 10/2002 Sato et al. ..... 345/212

FOREIGN PATENT DOCUMENTS

JP 2003-036056 2/2003

OTHER PUBLICATIONS

Communication from Korean Patent Office dated Mar. 2, 2006.

* cited by examiner

*Primary Examiner*—Chanh Nguyen
*Assistant Examiner*—Calvin C Ma
(74) *Attorney, Agent, or Firm*—McKenna Long & Aldridge LLP

(57) ABSTRACT

A method of driving a liquid crystal display to eliminate stripe-shaped noise when a picture screen is displayed on an enlarged viewing area includes dividing a liquid crystal into a plurality of blocks, and setting widths of scanning pulses for a gate electrode pair supplied with the same data differently for each block, wherein the gate electrode pair includes first and second gate lines.

3 Claims, 12 Drawing Sheets

METHOD OF DRIVING LIQUID CRYSTAL DISPLAY FOR EXPANDING AN EFFECTIVE PICTURE FIELD

This application claims the benefit of Korean Patent Application No. P2003-81426 filed on Nov. 18, 2003, which is hereby incorporated by reference for all purposes as if fully set forth herein.

BACKGROUND OF THE INVENTION

1. Field of the Invention

This invention relates to a liquid crystal display. More particularly, the invention relates to a method of driving a liquid crystal display that eliminates stripe-shaped noise when a picture is displayed on an enlarged area.

2. Description of the Related Art

A liquid crystal display (LCD) controls light transmittance of liquid crystal cells in accordance with video signals to display a picture. The LCD may be an active matrix type having a switching device for each cell and used in a display device, such as a monitor for a computer, office equipment, a cellular phone and the like. The switching device for the active matrix LCD mainly employs a thin film transistor (TFT).

FIG. 1 schematically shows a related art LCD driving apparatus.

Referring to FIG. 1, the related art LCD driving apparatus includes a liquid crystal display panel 2 having m×n liquid crystal cells Clc arranged in a matrix, m data lines D1 to Dm and n gate lines G1 to Gn crossing each other and thin film transistors TFT located at the crossings of the data and gate lines, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, and a timing controller 10 for controlling the data driver 4 and the gate driver 6.

The liquid crystal display panel 2 further includes a plurality of liquid crystal cells Clc arranged, in a matrix, at the intersections between the data lines D1 to Dm and the gate lines G1 to Gn. The thin film transistor TFT provided at the intersections for each liquid crystal cell Clc applies a data signal from each data line D1 to Dm to the liquid crystal cell Clc in response to a scanning signal from the gate line G. Further, each liquid crystal cell Clc includes a storage capacitor Cst. The storage capacitor Cst is provided between a pixel electrode of the liquid crystal cell Clc and a pre-stage gate line or between the pixel electrode of the liquid crystal cell Clc and a common electrode line to maintain a constant voltage of the liquid crystal cell Clc.

The gamma voltage supplier 8 applies a plurality of gamma voltages to the data driver 4 such that an analog data signal is generated.

The timing controller 10 generates a gate control signal GCS and a data control signal DCS using synchronizing signals (or a complex synchronizing signal) supplied from another system (not shown). Herein, the gate control signal GCS includes a gate start pulse GSP, a gate shift clock GSC and a gate output enable signal GOE. The data control signal DCS includes a source start pulse SSP, a source shift clock SSC, a source output enable signal SOE and a polarity signal POL. The timing controller 10 re-aligns the R, G and B data to apply them to the data driver 4.

The data driver 4 applies pixel signals for each line for every horizontal period in response to the data control signal DCS from the timing controller 10 to the data lines D1 to Dm.

Particularly, the data driver 4 converts digital R, G and B data from the timing controller 10 into analog pixel signals using gamma voltages from the gamma voltage supplier 8 to apply them to the data lines D1 to Dm.

More specifically, the data driver 4 shifts a source start pulse SSP in response to a source shift clock SSC to generate sampling signals. Then, the data driver 4 sequentially receives the R, G and B data for a certain unit in response to the sampling signals to latch them. Further, the data driver 4 converts the latched R, G and B data for one line into analog data signals to apply them to the data lines D1 to Dm in an enable interval of the source output enable signal SOE. Herein, the data driver 4 converts the data signals into positive signals or negative signals in response to a polarity control signal POL.

The gate driver 6 sequentially applies a scanning signal (or a gate high voltage) to the gate lines G1 to Gn in response to the gate control signal GCS from the timing controller 10. Thus, the thin film transistors TFT connected to the gate lines G1 to Gn are sequentially driven.

To this end, the gate driver 6 includes a plurality of gate integrated circuits 12, each of which is configured as shown in FIG. 2 schematically. Referring to FIG. 2, the gate integrated circuit 12 include a shift register block 14, a level shifter 18 and an output buffer 20.

The shift register block 14 consists of i shift registers 16 and 17 (wherein i is an integer). Such a shift register block 14 sequentially generates a shift pulse. The level shifter 18 generates a scanning signal using a shift pulse applied thereto. The output buffer 20 applies the scanning signal from the level shifter 18 to the corresponding gate line G.

Operation of the gate integrated circuit 12 will be described in detail with reference to FIG. 3.

First, the shift register block 14 receives the gate start pulse GSP signal and the gate shift clock GSC signal from the timing controller 10. The gate shift clock GSC has a period of one horizontal period 1H. The shift register block 14 having received the gate start pulse GSP and the gate shift clock GSC shifts the gate start pulse GSP from the 1st shift register 16 to the ith shift register 17 for each period of the gate shift clock GSC. Whenever the gate start pulse GSP is shifted to the adjacent shift register (i.e., every one horizontal period 1H), a shift pulse is generated from the corresponding shift register that is applied to the level shifter 18.

The level shifter 18 receives a gate output enable signal GOE from the timing controller 10. The gate output enable signal GOE is applied, via an inverter (not shown), to the level shifter 18. The level shifter 18 having received the shift pulse for each horizontal period 1H generates a scanning pulse corresponding to the shift pulse in a high interval (or a low interval upon going through the inverter) of the gate output enable signal GOE to apply the signal to the output buffer 20. The output buffer 20 sequentially applies the scanning signal supplied thereto to the gate lines G to sequentially drive the gate lines G.

In the related art as mentioned above, a desired picture is displayed on the liquid crystal display panel 2 that correspond to data signals and scanning signals from the data driver 4 and the gate driver 6. Recently, as various media have become available, image data having various formats have been used. When data having a specific format (e.g., a DVD format) is directly displayed on the display panel, as depicted in FIG. 4, the top portion 22 and the bottom portion 24 of the panel are displayed in a specific pattern (e.g., a black color). In other words, only a portion excluding the top portion 22 and the bottom portion 24 is used as an effective display part.

Accordingly, various schemes are necessary to use the entire panel, including the top portion 22 and the bottom portion 24 of the panel, as the effective display part. For example, data for one line is applied to two lines as shown in FIG. 5 to expand the effective display part. More specifically, first, the LCD supplies the same data for a given line unit (e.g., for a three line unit). In other words, data for the kth gate line Gk (wherein k is 1, 4, 7, 10 . . . ) and for the (k+1)th gate line Gk+1 is supplied with no change from the initial data, whereas data for the (k+2)th gate line Gk+2 are supplied two lines by two lines to expand the picture screen. In other words, as shown in FIG. 5, data for the first and second gate lines G1 and G2 is supplied with no change, while data for the third gate line G3 is supplied to the third and fourth gate lines G3 and G4 to obtain an expanded effective display part like the right screen of FIG. 4.

To this end, a period of the gate shift clock GSC is changed to a ½ horizontal period in a given line unit as shown in FIG. 6. The gate shift clock GSC having the normal period allows a scanning signal having about one horizontal period to be applied to the first and second gate lines G1 and G2, whereas the gate shift clock GSC having a period of ½ horizontal period allows a scanning signal having about ½ horizontal period to be applied to the third and fourth gate lines G3 and G4. Herein, the third and fourth gate lines G3 and G4 are supplied with the same data D3, thereby expanding the picture field.

However, such a related art field expansion method has a problem in that noise is generated for each line. Furthermore, because a period of the scanning signal applied to the third and fourth gate lines G3 and G4 is different from periods of other scanning signals, a reduced picture quality for each line occurs at a particular area of the liquid crystal display panel 2.

SUMMARY OF THE INVENTION

Accordingly, the present invention is directed to a method of driving a liquid crystal display that substantially obviates one or more of the problems due to limitations and disadvantages of the related art.

An advantage of the present invention is to provide a method of driving a liquid crystal display that eliminates stripe-shaped noise when a picture is displayed on an enlarged viewing area.

Additional features and advantages of the invention will be set forth in the description which follows, and in part will be apparent from the description, or may be learned by practice of the invention. The advantages of the invention will be realized and attained by the structure particularly pointed out in the written description and claims hereof, as well as the appended drawings.

To achieve these and other advantages and in accordance with the purpose of the present invention, as embodied and broadly described, a method of driving a liquid crystal display in which an effective picture field is displayed on an expanded viewing area includes dividing a liquid crystal display panel into a plurality of blocks; and setting widths of scanning pulses for a gate electrode pair supplied with the same data differently for each of the plurality of blocks, wherein the gate electrode pair includes first and second gate lines.

In another embodiment of the present invention, a method of driving a liquid crystal display in which the same data is supplied to a gate electrode pair of a particular line unit when an effective picture field is expanded includes dividing a liquid crystal display panel into a plurality of blocks so as to include at least one gate electrode pair; controlling a width of a scanning pulse for a first gate line of said gate electrode pair such that said width of the scanning pulse becomes narrower in a progression from a first block to a last block of the plurality of blocks in correspondence with an ith vertical synchronizing signal, wherein i is an odd number or an even number; and controlling a width of a scanning pulse for a first gate line of said gate electrode pair such that said width of the scanning pulse becomes wider in a progression from the first block to the last block in correspondence with an (i+1)th vertical synchronizing signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 7:
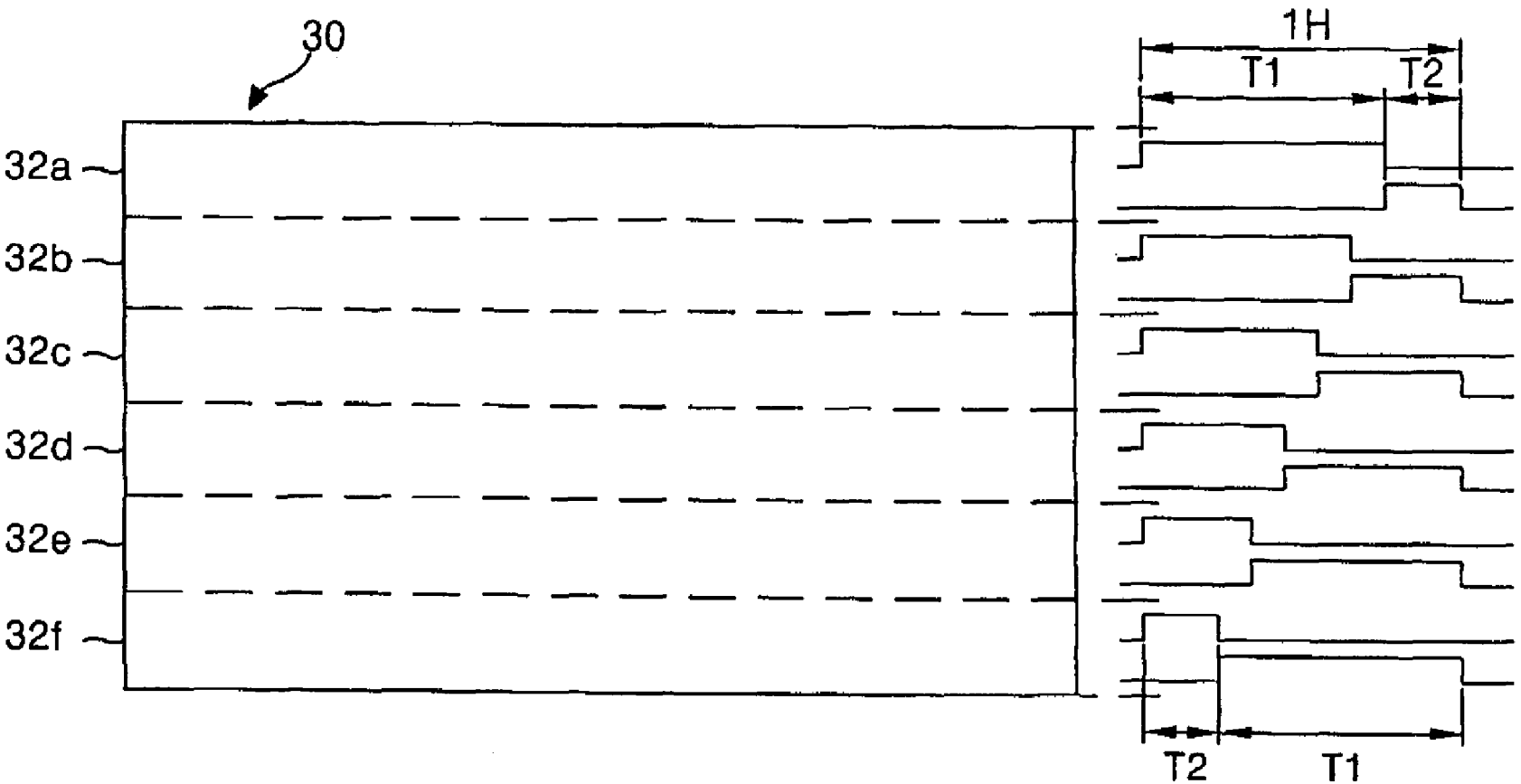
FIG. 7 illustrates a method of driving a liquid crystal display according to a first embodiment of the present invention.

FIG. 7 shows a method of driving a liquid crystal display (LCD) according to a first embodiment of the present invention.

In FIG. 7, a liquid crystal display panel 30 is divided into a plurality of blocks 32*a* to 32*f*. A width of a scanning pulse applied to each block 32*a* to 32*f* is controlled to prevent a reduced picture quality for each line.

Figure 1:
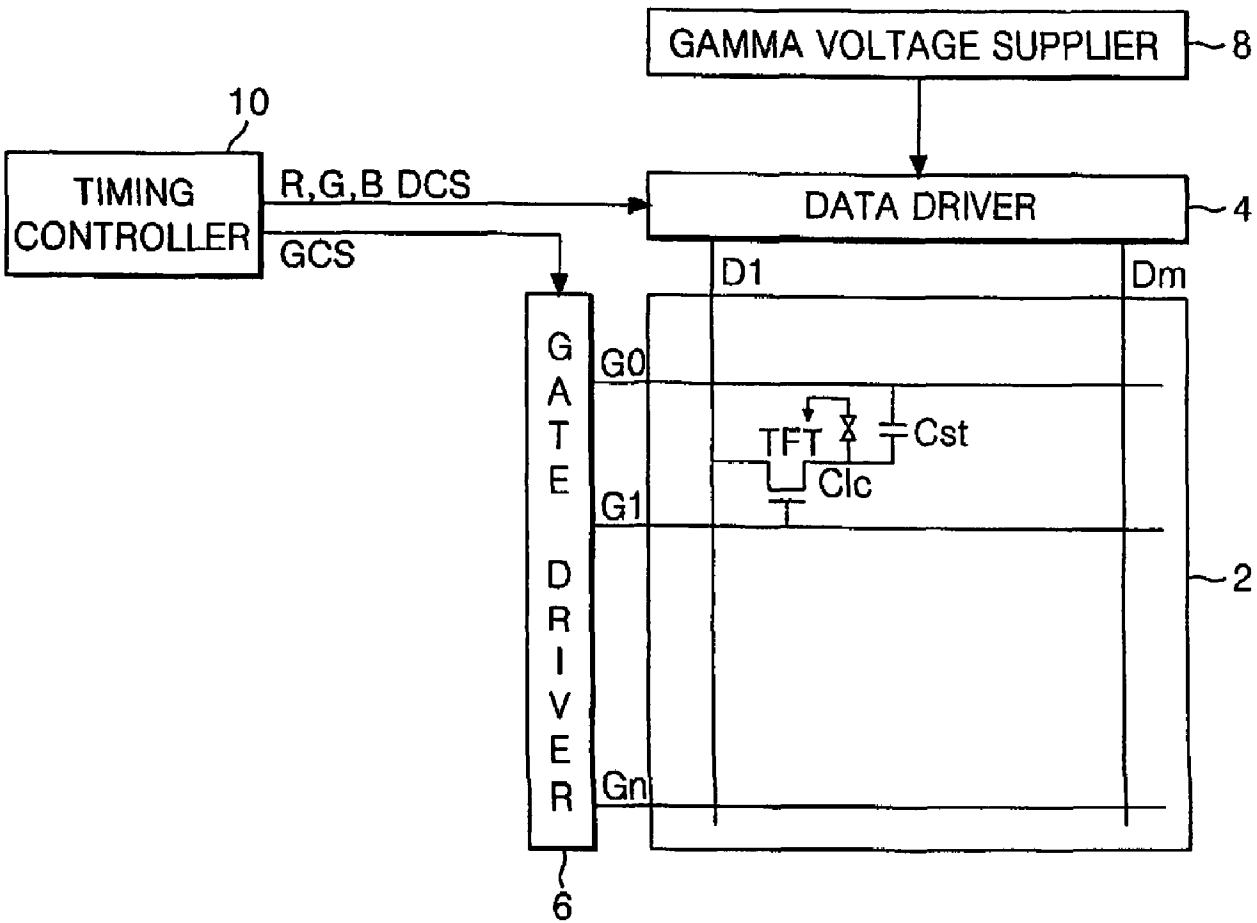
FIG. 1 RELATED ART
FIG. 1 is a schematic block diagram showing a configuration of a related art liquid crystal display.
Figure 2:
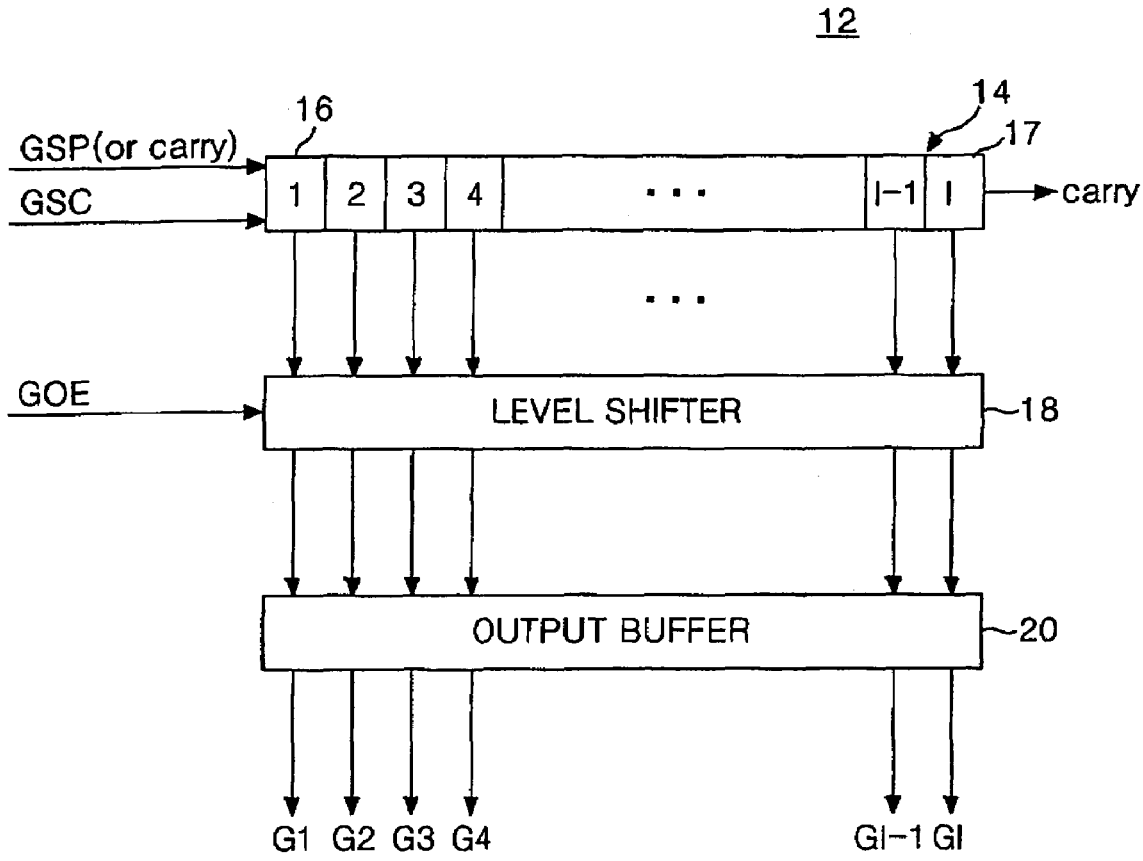
FIG. 2 RELATED ART
FIG. 2 is a schematic block diagram of the gate driver in the liquid crystal display shown in FIG. 1.
Figure 3:
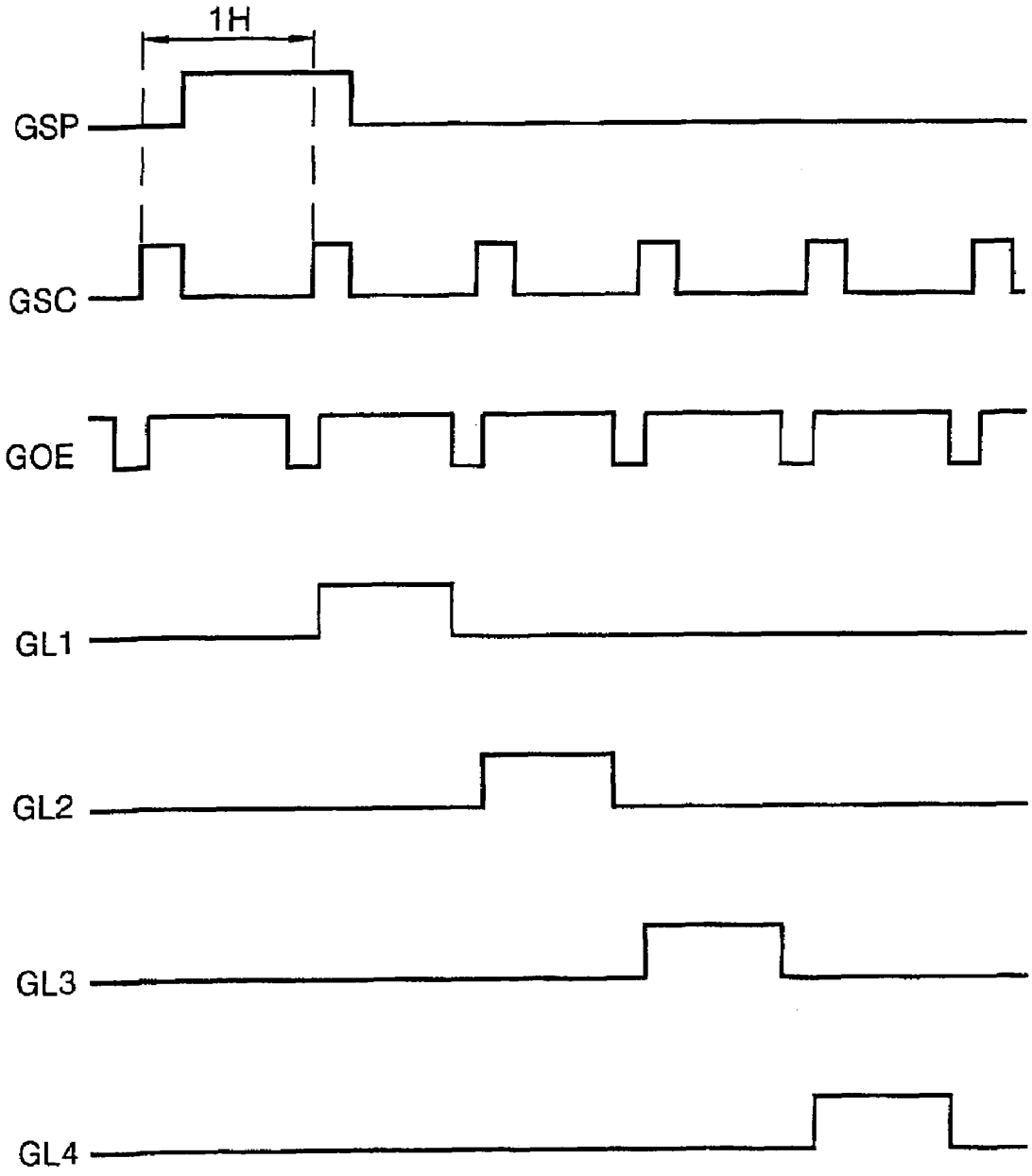
FIG.3 RELATED ART
FIG. 3 is a waveform diagram showing a process of generating a scanning signal from the gate driver shown in FIG. 2.
Figure 4:
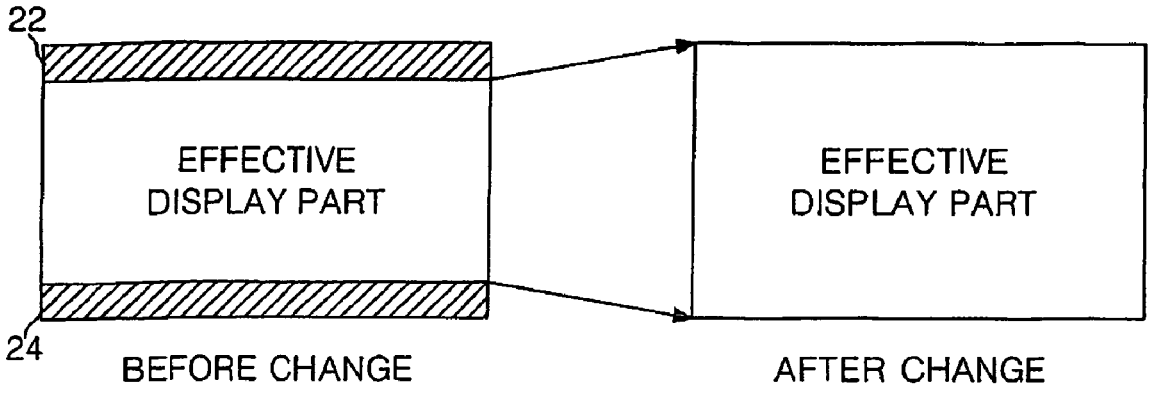
FIG. 4 RELATED ART
FIG. 4 and FIG. 5 depict expansion methods of the effective display part.
Figure 5:
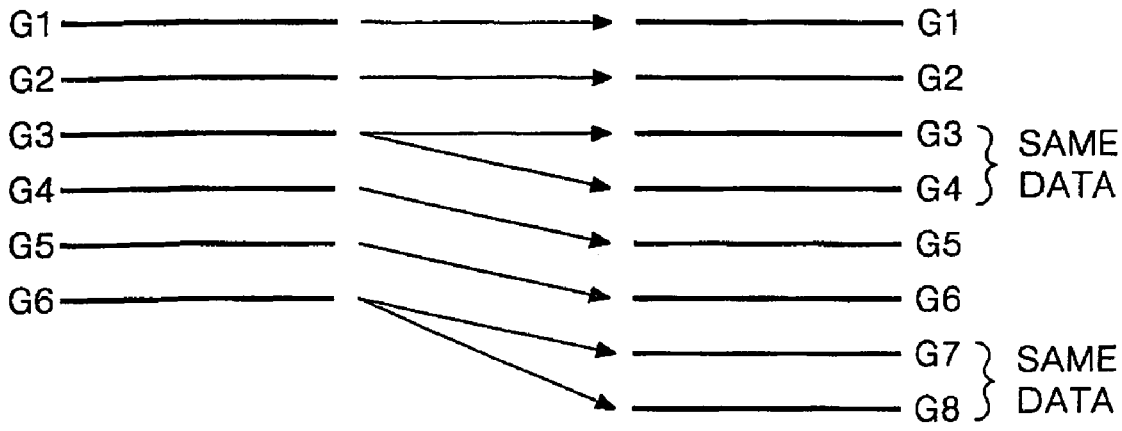
FIG. 5 RELATED ART
Figure 6:
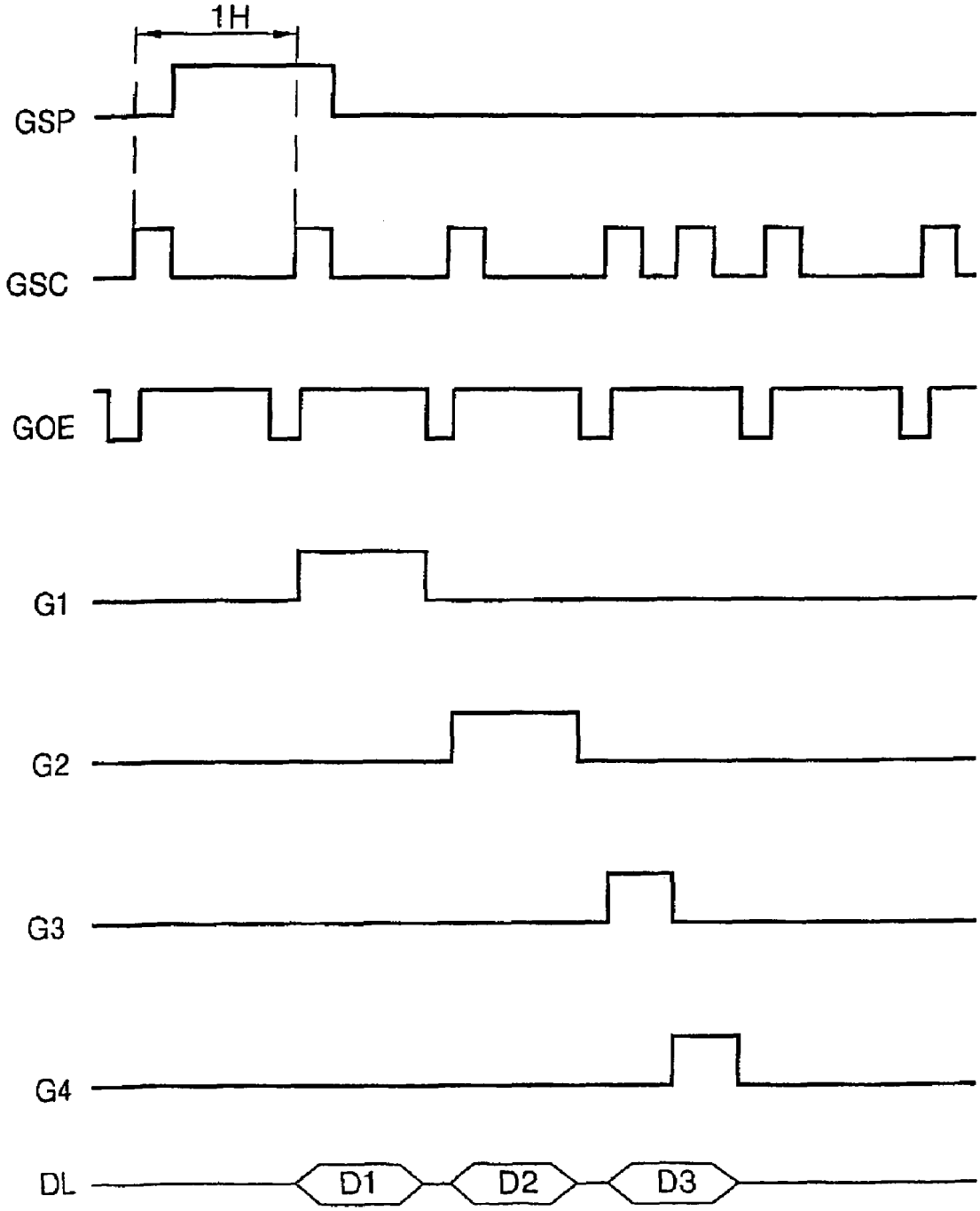
FIG. 6 RELATED ART
FIG. 6 is a waveform diagram showing an application of the same data to the gate electrode pair for a particular line unit for the purpose of expanding the effective display part.

The details of FIG. 7 will be described with reference to FIG. 5.

First, widths of the scanning pulses from the gate lines having different data from each other are set to be similar to those discussed with respect to the prior art. In other words, widths of the scanning signals from the gate lines G1 and G2, having received one data signal during one horizontal period, are set equally at all the blocks 32*a* to 32*f*.

Whereas, in an embodiment of the present invention, widths of the scanning signals from the gate lines supplied with the same data are set differently for each block 32*a* to 32*f*. In other words, a width of the scanning signal from the first gate line (i.e., G3 in FIG. 8A and FIG. 8B) of the gate line pair having received the same data for each block 32*a* to 32*f* and a width of the scanning signal from the second gate line (i.e., G4 in FIG. 8A and FIG. 8B) are variously set for each block 32*a* to 32*f*.

As shown in FIG. 7, at the first block 32*a*, a width of the scanning signal from the first gate line, of the gate line pair having received the same data, is set widely, while a width of the second scanning signal from the second gate line is set narrowly. At the last block 32*f*, a width of the scanning signal from the first gate line, of the gate line pair having received the same data, is set narrowly while a width of the second scanning signal from the second gate line is set widely. In other words, a width of the scanning signal from the first gate line, of the gate line pair having received the same data, becomes narrower as it goes from the first block 32*a* to the last block 32*f*. Whereas, a width of the scanning signal from the second gate line becomes wider as it goes from the first block 32*a* to the last block 32*f*.

When widths of the gate line pair supplied with the same data for each block 32*a* to 32*f* are set differently, then it becomes possible to prevent the generation of a reduced picture quality for each line when the picture field is expanded. In other words, widths of the gate line pair supplied with the same data for each block 32*a* to 32*f* of the liquid crystal display panel 22*a* are set differently to maintain an average uniform liquid crystal charging time, and prevent a reduced picture quality phenomenon.

Figure 9:
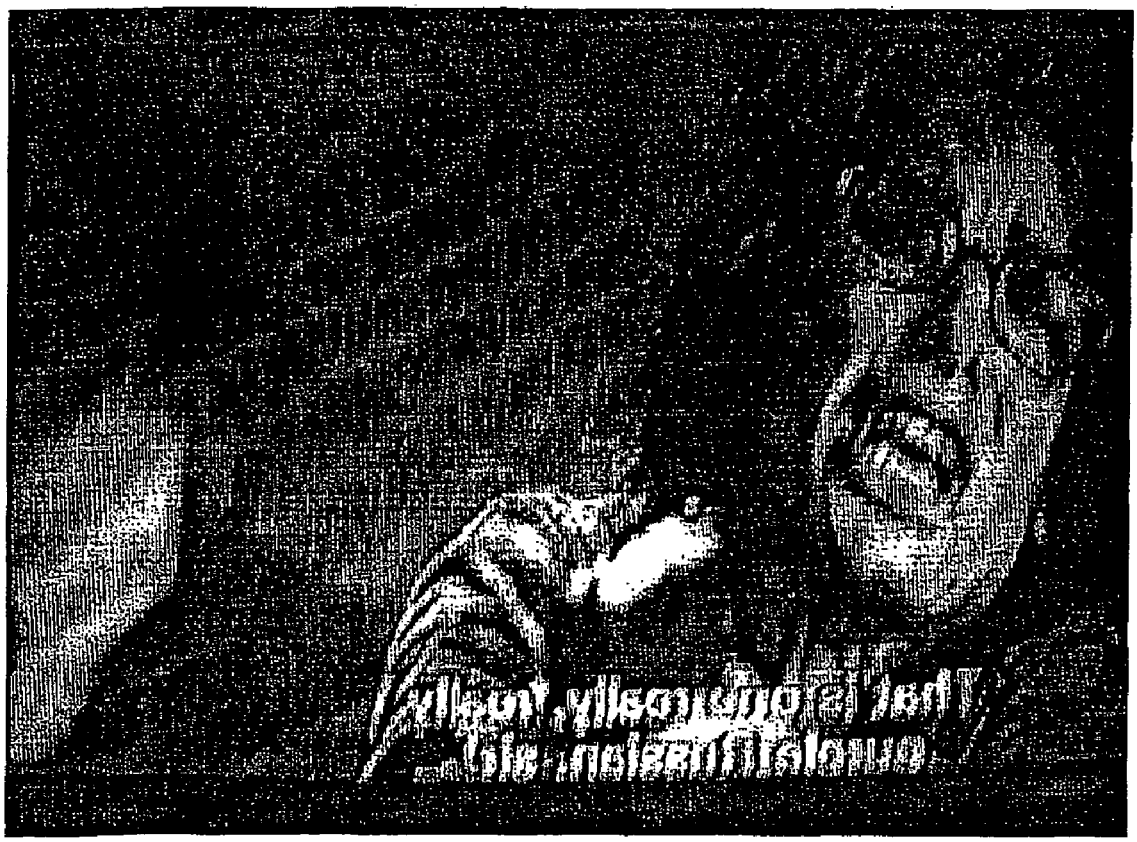
FIG. 9 shows a picture displayed by the related art expansion method.
Figure 10:
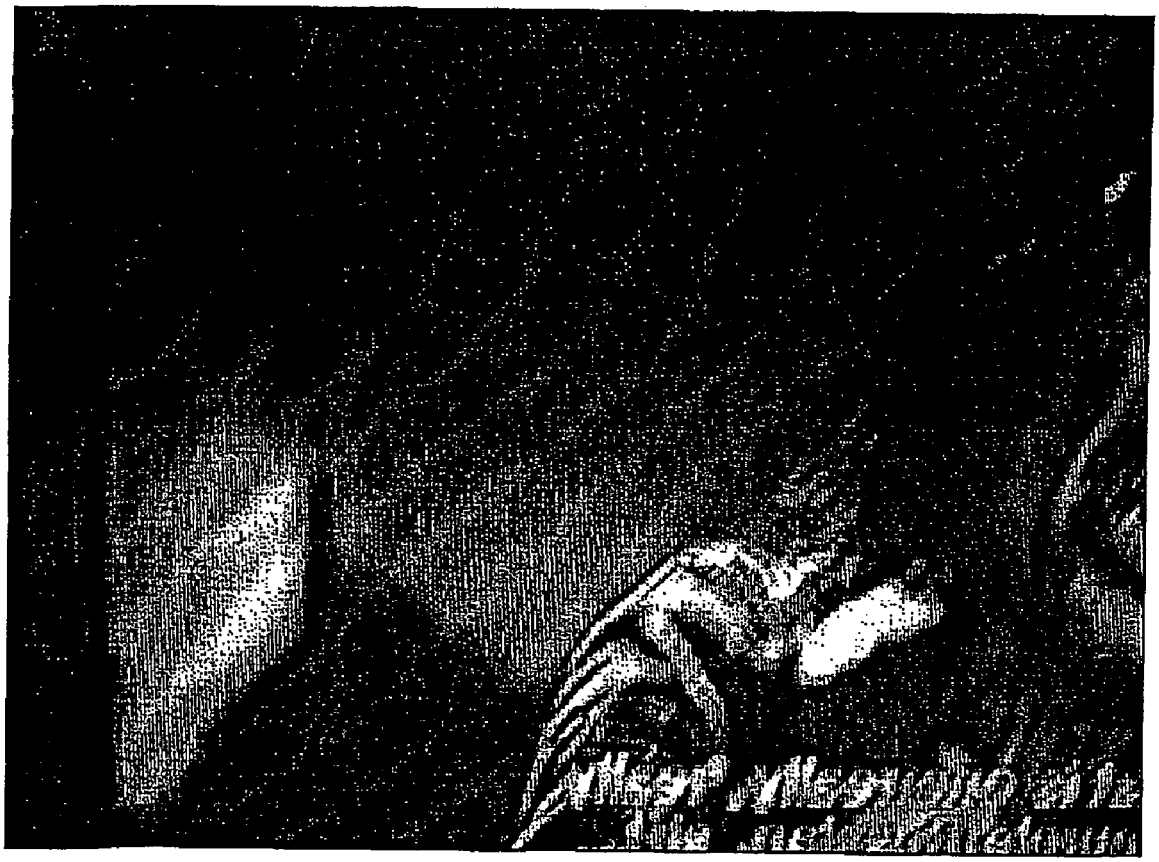
FIG. 10 shows a picture displayed by the expansion method according to the first embodiment of the present invention.

When the effective display part of the screen is expanded by the related art method, a reduced picture quality results for each line, as shown in FIG. 9, and can be observed by the human eye. On the other hand, when the effective display part of the screen is expanded by a method in accordance with the embodiment of the present invention as depicted in FIG. 7, the reduced picture quality phenomenon for each line does not result, as can be seen from FIG. 10.

Figure 8A:
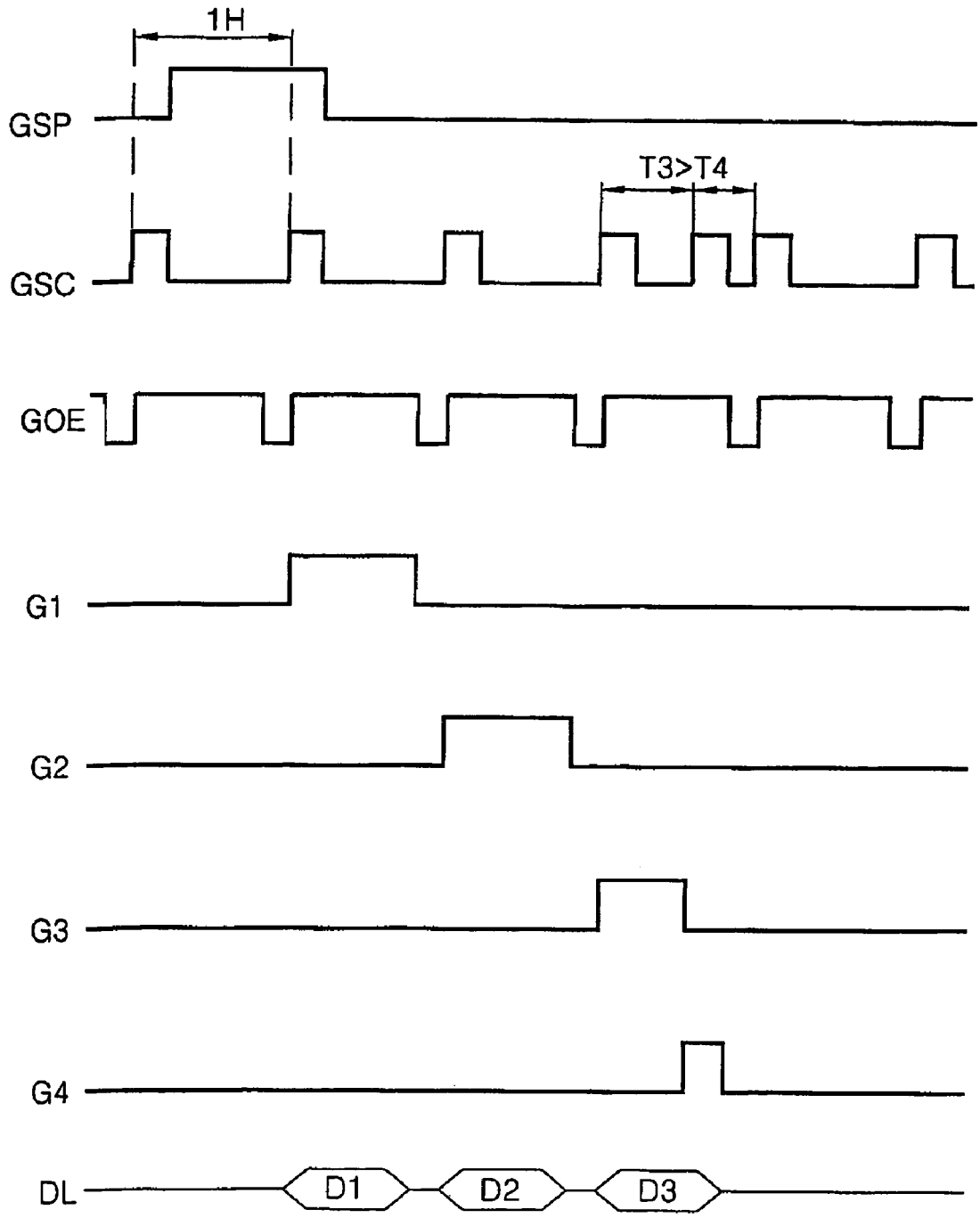
FIG. 8A and FIG. 8B are waveform diagrams showing a scheme of generating the scanning pulse shown in FIG. 7.
Figure 8B:
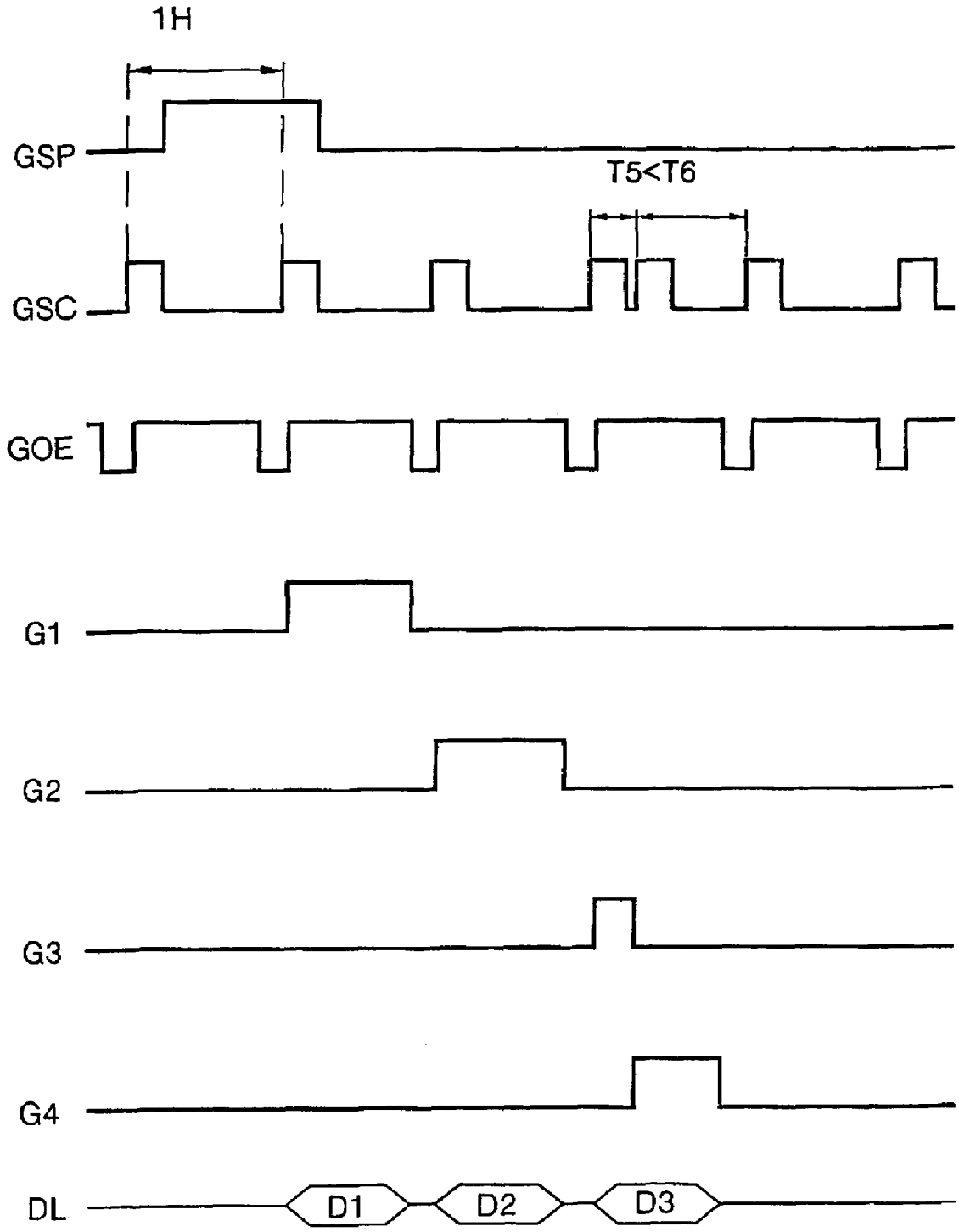

Returning to FIGS. 8A and 8*b*, a period of the gate shift clock GSC is adjusted to control the width of the gate signal for each block. In other words, in order to increase a width of the first gate line of the gate line pair supplied with the same data, a period T3 of the gate shift clock GSC corresponding to the first gate line is set to have a longer cycle (i.e., to more than ½ horizontal period) while a period T4 of the gate shift clock GSC corresponding to the second gate line is have a shorter cycle (i.e., to less than ½ horizontal period) as shown in FIG. 8A. Otherwise, in order to reduce the width of the first gate line of the gate line pair supplied with the same data, a period T5 of the gate shift clock GSC corresponding to the first gate line is set to have a shorter cycle (i.e., to less than ½ horizontal period), while a period T6 of the gate shift clock GSC corresponding to the second gate line is set widely (i.e., to more than ½ horizontal period) as shown in FIG. 8B. In this manner, the scanning pulses of the gate line pair can be variously set for each block 32*a* to 32*f* of the liquid crystal display panel 30 as shown in FIG. 7.

Figure 11:
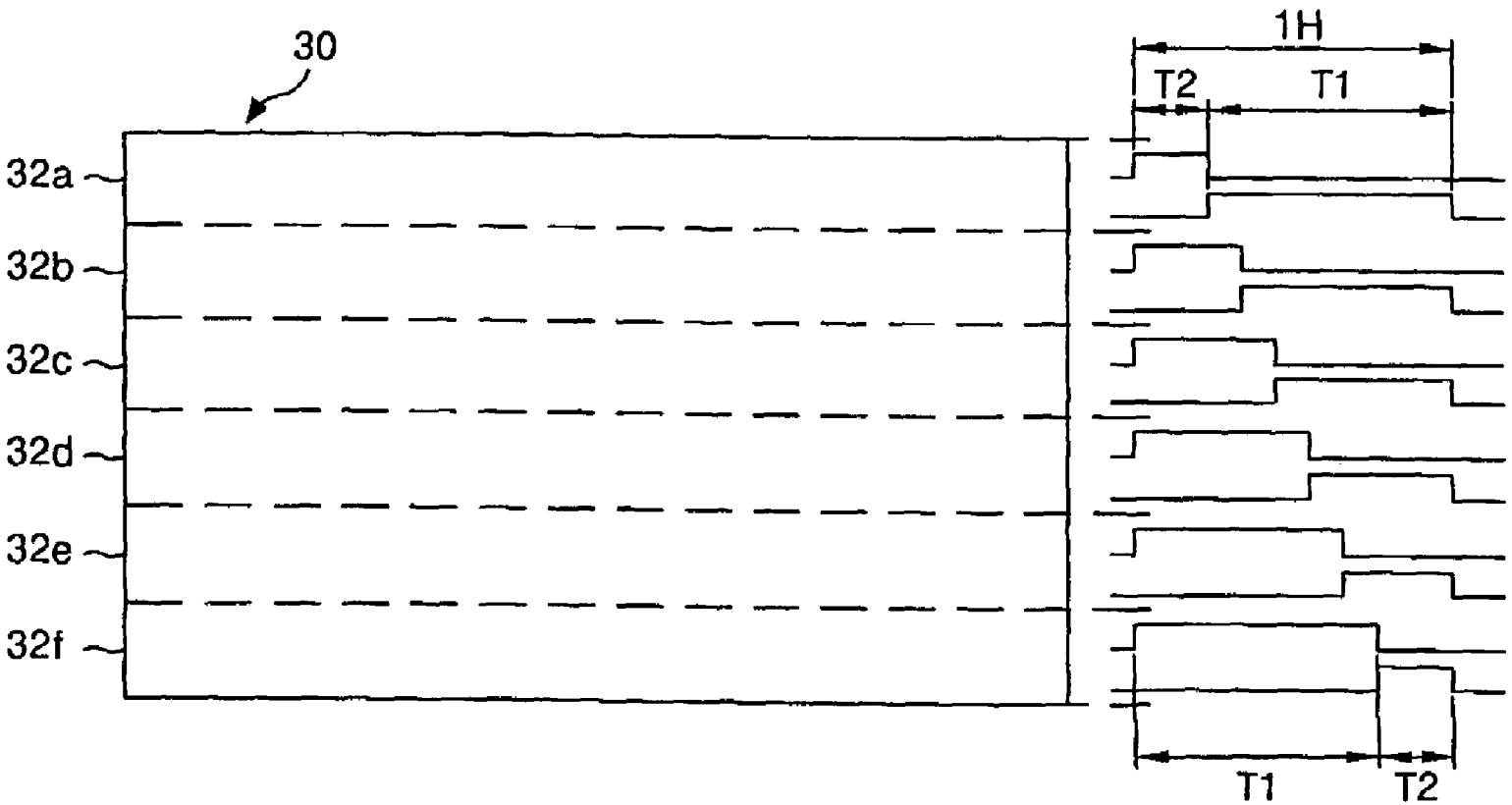
FIG. 11 illustrates a method of driving a liquid crystal display according to a first embodiment of the present invention.

In a second embodiment, illustrated in FIG. 11, at the first block 32*a*, a width of the scanning signal from the first gate line of the gate line pair having received the same data may be set narrowly, while a width of the second scanning signal from the second gate line may be set widely. At the last block 32*f*, a width of the scanning signal from the first gate line of the gate line pair having received the same data is set widely, while a width of the second scanning signal from the second gate line is set narrowly. In other words, in FIG. 11, a width of the scanning signal from the first gate line of the gate line pair having received the same data becomes wider as it goes from the first block 32*a* to the last block 32*f*, whereas a width of the scanning signal from the second gate line thereof narrows as it goes from the first block 32*a* to the last block 32*f*. If the widths of the gate line pair supplied with the same data for each block 32*a* to 32*f* are set differently, then it is possible to prevent the generation of a reduced picture quality for each line when the picture field is expanded.

The first embodiment shown in FIG. 7 and the second embodiment shown in FIG. 11 may be alternated for each frame. In other words, the first embodiment and the second embodiment of the present invention may be alternately applied on the basis of the vertical synchronizing signal V to prevent a reduced picture quality badness phenomenon for each line.

As described above, according to the present invention, the liquid crystal display panel is divided into a plurality of blocks when a picture is displayed on an expanded display area and widths of scanning signals from the gate line pair supplied with the same data may be controlled at each block to prevent a generation of reduced picture quality phenomenon for each line.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display, including the liquid crystal panel, which is divided into a plurality of blocks having a first gate electrode pair to which scanning pulses of a first width are sequentially supplied and a second gate electrode pair to which scanning pulses of a second and third widths shorter than the first width are sequentially supplied, and in which an effective picture field is displayed on an expanded basis, the method comprising:

sequentially generating a first shift clock for controlling supply of scanning pulse having the second width and a second shift clock for controlling supply of scanning pulses having the third width in order to supply the same data during scanning pulses having the second and third widths are sequentially supplied to the second gate electrode pair in one horizontal period when the effective field is expanded;

supplying scanning pulses of the second width to one gate electrode of the second gate electrode pair in accordance with the first shift clock;

supplying scanning pulses of the third width having different period from the second width to another gate electrode of the second gate electrode pair in accordance with the second shift clock; and a first frame controlling the second width of the scanning pulse, which is supplied to the first gate electrode of the second gate electrode pair, to be narrowed as said scan pulse goes from a first block into a last block in the plurality of blocks; and a second frame controlling the second width of the scanning pulse, which is supplied to the first gate electrode of the second gate electrode pair, to be widened as said scan pulse goes from the first block into the last block, wherein the first and second frames is alternated.

2. The method of driving the liquid crystal display according to claim 1, wherein the third width of the scanning pulse, which is supplied to the second gate electrode of the second gate electrode pair, is widened as said scan pulse goes from the first block into the last block in the first frame.

3. The method of driving the liquid crystal display according to claim 1, wherein the third width of the scanning pulse, which is supplied to the second gate electrode of the second gate electrode pair, is narrowed as said scan pulse goes from the first block into the last block in the second frame.

* * * * *